United States Patent [19]

Holz et al.

[11] 4,410,399

[45] Oct. 18, 1983

[54] SELF-SEALING DOOR ASSEMBLY FOR A COKE OVEN

[75] Inventors: Wilhelm Holz, Gelsenkirchen-Buer; Helmut Lukaszewicz, Bottrop, both of Fed. Rep. of Germany

[73] Assignee: Ruhrkohle Aktiengesellschaft, Essen, Fed. Rep. of Germany

[21] Appl. No.: 341,998

[22] PCT Filed: Jun. 29, 1981

[86] PCT No.: PCT/DE81/00101

§ 371 Date: Jan. 11, 1982

§ 102(e) Date: Jan. 11, 1982

[30] Foreign Application Priority Data

Jun. 28, 1980 [DE] Fed. Rep. of Germany ..... 3024514

[51] Int. Cl.[3] ..... C10B 25/06; C10B 29/04

[52] U.S. Cl. ..... 202/248; 202/268

[58] Field of Search ..... 202/248, 268, 270; 110/173 R; 49/485

[56] References Cited

U.S. PATENT DOCUMENTS

| | | | |
|---|---|---|---|
| 4,036,702 | 7/1977 | Nagayoshi | 202/248 |
| 4,110,173 | 8/1978 | Dix | 202/248 |
| 4,263,101 | 4/1981 | Thiersch et al. | 202/248 |
| 4,293,389 | 10/1981 | Clement | 202/248 |

FOREIGN PATENT DOCUMENTS

| | | | |
|---|---|---|---|
| 1041005 | 10/1958 | Fed. Rep. of Germany | 202/248 |
| 2,709,678 | 9/1978 | Fed. Rep. of Germany | 202/268 |
| 1098518 | 8/1955 | France . | |

*Primary Examiner*—Bradley Garris

*Attorney, Agent, or Firm*—Andrus, Sceales, Starke & Sawall

[57] ABSTRACT

A self-sealing door assembly for a coke oven comprises a door frame affixed around the oven opening, the surfaces of the frame facing the oven defining a gap which is filled with heat insulating material, and the outer front surfaces of the frame cooperating with iron sealing strips on the body of the door. The gap filled with insulating material is defined between the vertical and transverse surfaces on the door frame facing the oven and an internal angle-sectioned cover divided around the periphery of the door frame into a plurality of overlapping sections which are supported on distance pieces attached to the surfaces of the door frame.

6 Claims, 5 Drawing Figures

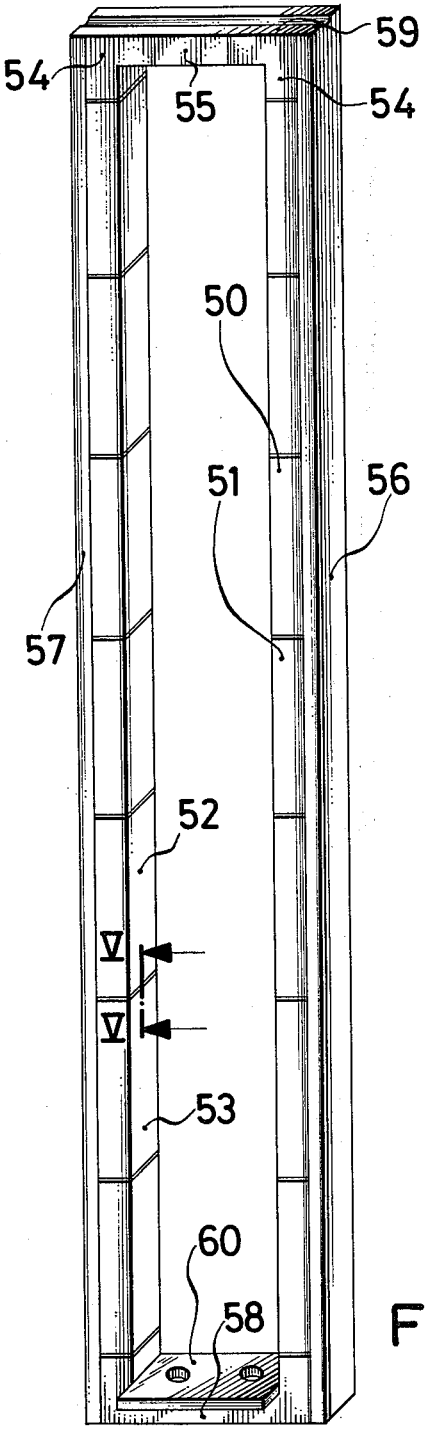
FIG. 3
FIG. 4
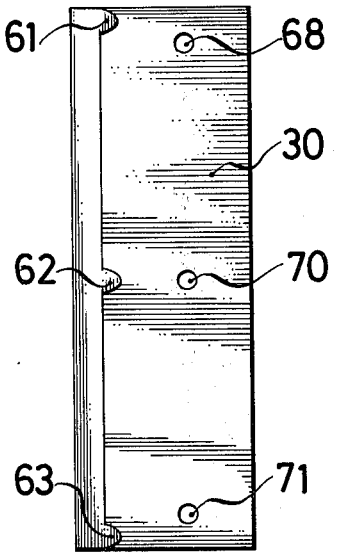
FIG. 5
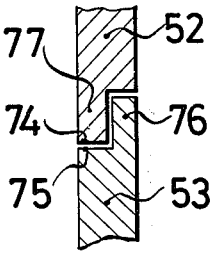

SELF-SEALING DOOR ASSEMBLY FOR A COKE OVEN

BACKGROUND OF THE INVENTION

This invention relates to a self-sealing door assembly for a coke oven, comprising a door frame affixed around the oven opening, the surfaces of the frame facing the oven defining a gap which is filled with heat insulating material, and the outer front surface of the frame cooperating with sealing strips on the body of the door.

In such types of door assembly for coke ovens, the body of the door usually has on the oven side iron sealing strips which are mostly adjustable and are supported on the outer front surface of the door frame, so as to effect sealing. The sealing is necessary so as to prevent any emissions from within the chamber of the coke oven or to limit such emissions to a small amount, and to protect the door components from the thermal stresses associated with these emissions. The door frame is also included in the parts which undergo thermal stress, because it has surfaces on the side facing the oven which lie behind the sealing strips and which are therefore subject to the effects of heat. To take account of these conditions, a gap is provided between the surfaces of the door frame facing the oven and the brick oven opening, this gap being filled with heat insulating material.

It is known that the door frames can be produced with various profiles, so as to compensate for thermal stresses. So-called block frame profiles work better than ribbed profiles. It is also known that the effect of high temperatures on cast iron of a certain composition leads to a conversion of the carbide carbon in ferrite and graphite. This conversion is associated with a reduction in the strength factors and therefore leads to damage to the door frame, which can be prematurely destroyed. In order to meet this problem, the door frame is made in such a way that it can be replaced.

This invention proceeds from the appreciation that the measures taken hitherto do not take sufficient account of the thermal stresses of the door frame. Between the periods in which the oven chamber is loaded, an approximately constant temperature gradient is formed in the door frame profile. This means that the temperature difference between the heat radiated from the hot part of the oven chamber and the heat of the door frame radiated into the atmosphere is approximately constant. The oven locks and therefore also the seals can be successfully adjusted to this temperature gradient, so that during coking time the emissions are greatly reduced. However, if the charging process is included then there occurs a drastic change in the temperature gradient. This is above all to be attributed to the high thermal stress of the surfaces of the door frame on the oven side during compression of the coke. It leads to one-sided heating of the door frame. This results in lengthwise distortion which has become known by the phrase "waisting".

Attempts have been made by structural means to secure the door frame to such an extent that waisting is at least limited. Shims and clamps, which are used in practice, serve this purpose. However, results by this means are comparatively ineffective with regard to distortions caused by temporary spontaneous heating of the parts facing the oven. These distortions cause the above-mentioned joint of the frame to become unsealed, and moreover distort the door frame to such an extent that the oven locks no longer seal. Particularly during the period of the first coking phase, increased emissions occur.

The object of this invention is to stabilise the temperature gradient in the door frame during the charging process, so as to eliminate the above-mentioned disadvantages.

SUMMARY OF THE INVENTION

According to the invention there is provided a self-sealing door assembly for a coke oven, comprising a door frame affixed around the oven opening, the surfaces of the frame facing the oven defining a gap which is filled with heat insulating material, and the outer front surfaces of the frame cooperating with sealing strips on the body of the door, said gap being defined between the vertical and transverse surfaces on the door frame facing the oven and an internal cover divided around the periphery of the door frame into a plurality of overlapping sections.

During the charging process, the cover, which consists of a material resistant to high temperatures, prevents a one-sided spontaneous heating of the door frame by interacting with the insulating material lying behind it, whereby the overlapping formation serves as compensation for linear expansion and at the same time prevents the insulating material from becoming contaminated. Therefore the temperature gradient of the door frame during the charging process largely corresponds to the temperature gradient between the charging processes, during which time there is a state of thermal stability. The chamber locks which are adjusted to this state can therefore achieve a high degree of sealing directly after the charging process so that unnecessary emissions are avoided.

Moreover, the cover has the advantage that it protects the door frame against the effects of too high temperatures, so that the above-mentioned structural transformations in the cast iron material of the door frame cannot occur. The working life of the door frame is therefore greatly increased.

Preferably the sections are supported on distance pieces which are attached to the surfaces of the door frame. By this means an approximately constant cross-section of the gap can be achieved, and the gap can be filled with an insulating material having a low mechanical strength, for example, with mineral wool.

The cover is preferably angle-sectioned and has a first flange engaging the rear of the door frame, a second flange overlapping the surface of the door frame facing the opening, and having connected thereto a further flange which is in alignment with the front surface of the door frame. The first and further flanges are preferably substantially parallel. Such an embodiment assumes that the whole surface of the door frame on the oven chamber side is available for carrying out the invention. However, generally this can only be achieved in new installations.

If it is desired to use the invention as a modification of existing coke ovens, then generally on the front surface of the door frame there is not enough room to accommodate both the cover and the gap. It is then appropriate for the cover to be angle-sectioned and to have a first flange engaging the rear of the door frame, and a second flange overlapping the surface of the door frame facing the opening, which second flange is reduced in thickness at its free end. Then the gap can be increased at the free end of the flange and more mineral wool can be placed there so as to increase the insulation accordingly.

In either of the above arrangements the flanges of the cover are preferably integrally formed as a unit.

Details, further features and other advantages of the invention are given in the following description of two embodiments of the invention, which are suitable for carrying out the invention in existing installations and in new installations respectively.

BRIEF DESCRIPTION OF THE DRAWINGS

FIG. 3 is a diagrammatic perspective view of the door frame, FIG. 4 shows a cover plate, and FIG. 5 is a sectional view of an overlap taken along the line V—V in FIG. 3.

DETAILED DESCRIPTION OF THE PREFERRED EMBODIMENTS

Figure 1:
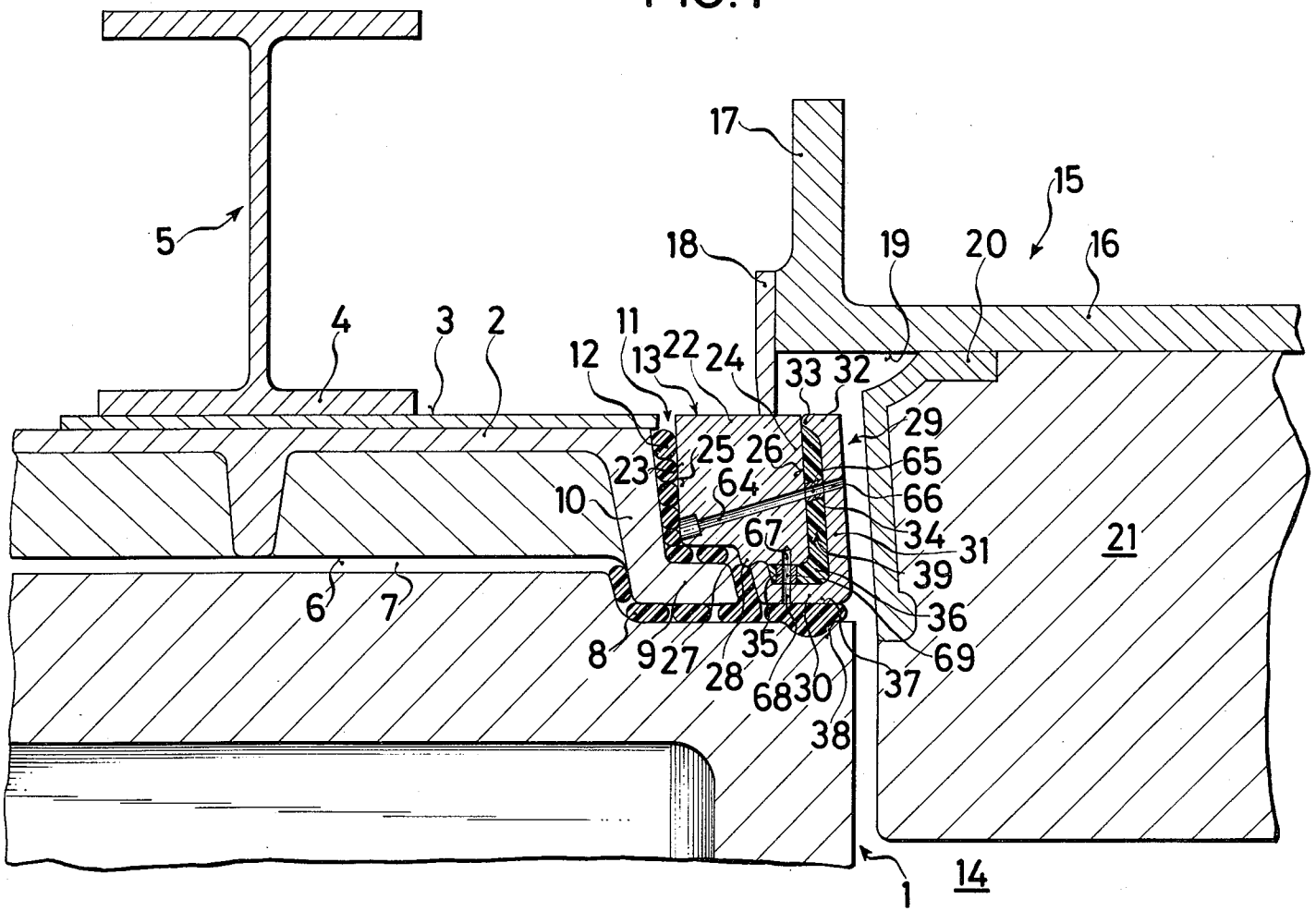
FIG. 1 shows a self-sealing chamber door for a coke oven according to the invention for use in new installations, viewed in partial section through the closed oven door and the opening of the oven as far as a supporting post.

Referring to FIG. 1, the brick opening 1 of the oven is provided on its outer side with a wall protection plate 2, on the outer surface 3 of which is supported the flange 4 on the oven side of an I-sectioned supporting post 5. The wall protection plate 2 has a peripheral edge 6 and between this edge and the oven wall is a gap 7. This gap is filled with heat insulating material, which is shown at 8. As can be seen from FIG. 1, the edge 6 is formed from an angled section 9,10 of the wall protection plate. The free flange of the angled section is given the reference numeral 9, while the other flange 10 leads from the free flange 9 to the flat section of the wall protection plate 2 and is inclined as it extends outwardly, the parts 2, 9 and 10 being integrally formed in one piece. The angled section formed by the flanges 9 and 10 defines one side of a further gap 11, which is filled with heat insulating material, as shown at 12. The other side of this gap is defined by the surface of a vertical post 56 of the door frame 13. As shown in FIG. 3, the door frame is formed from the post 56, an upper horizontal cross-piece 59 which extends over the oven opening, a parallel post 57 on the other side of the opening, and a lower cross-piece 58.

The inside of the oven chamber is given the reference numeral 14 and is separated from the outside by a door 15. The door has a frame 16 made of cast iron which has flanges 17 directed outwardly. Sealing strips 18 made of iron are attached to these flanges, these strips being adjustable. On the inside 19 of the frame 16 there is a brick support 20 which has a covering of insulating material 21.

The door frame posts 56 and 57 are block-shaped, that is, they are each essentially in the shape of a square or rectangle. As shown in FIG. 1, the shorter side 22 of the rectangle forms, with its outer surface, the front side of the door frame, whilst the sides 23 and 24 which are approximately parallel and perpendicular to the side 22 border the above-mentioned gap 11 with their outer surfaces 25 and 26, and extend towards the oven chamber. The fourth side of the rectangle is provided with a re-entrant section 27 and a projecting section 28, corresponding to the angled section 9,10.

Figure 2:
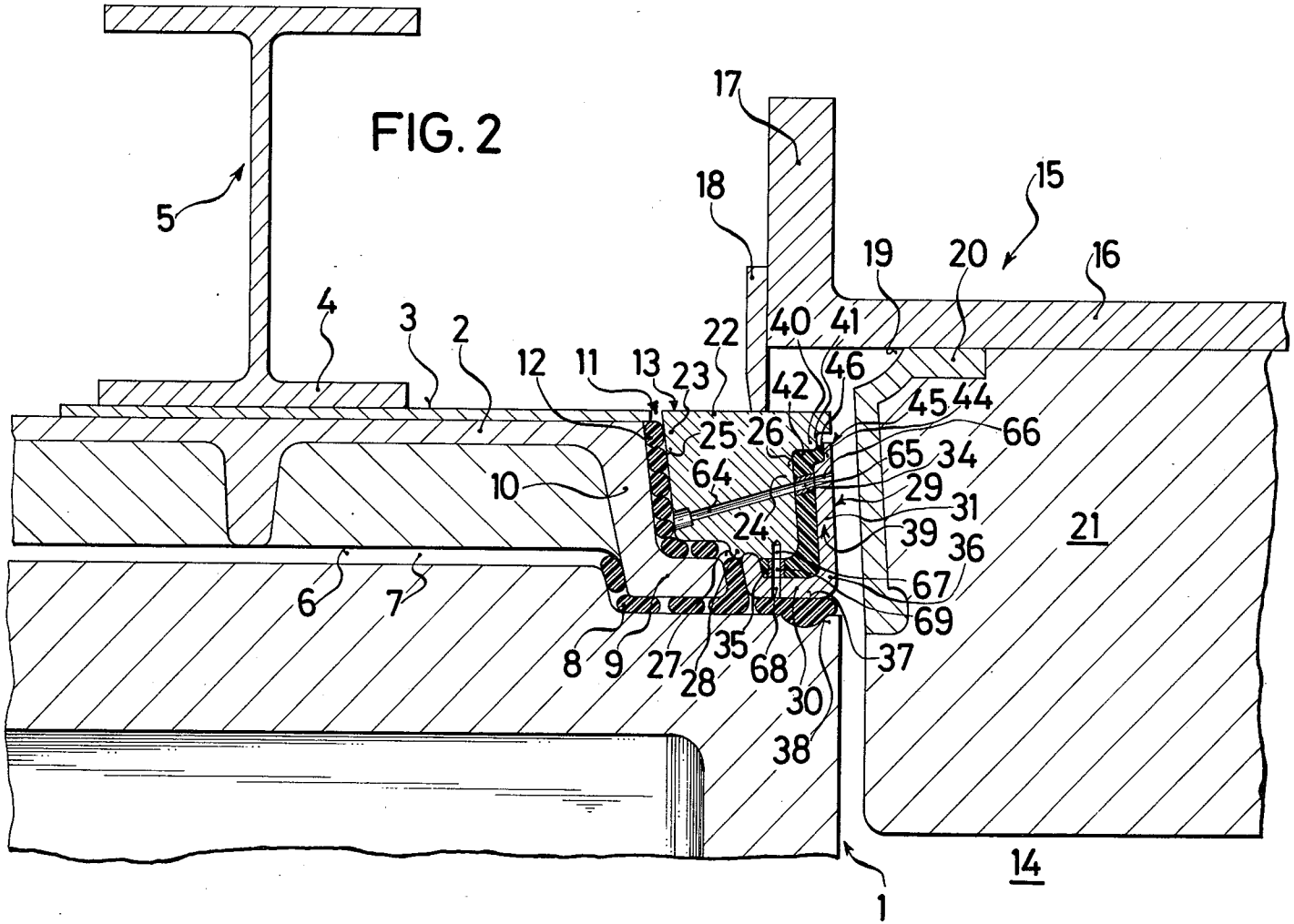
FIG. 2 is a view corresponding to FIG. 1, showing a self-sealing chamber door for a coke oven according to the invention for use in existing installations.

As can be seen from FIGS. 1 and 2, the width of the front surface of the frame, which is given by the side 22 of the rectangle, enables a more reliable positioning of the sealing strip 18 on the front side of the frame, taking into account the changes in dimension caused by thermal stresses. In the arrangement of FIG. 1, it has also been taken into account that the width of the side 22 of the door posts, together with the dimensions of a cover 29 in the same direction, which cover is to be described later, should result in a sufficiently wide door opening. However, this can usually only be achieved in new installations.

A modification of an existing installation is shown in FIG. 2. Here an increase in the width of the door frame cannot be made without reducing the width of the door opening to an unsatisfactory degree. Also, the width of the side 22 cannot be shortened without too much reduction in the tolerance for the positioning of the sealing strip 18. A door frame in which the width of the side 22 cannot be altered in this way is usually provided in existing installations. The embodiment shown in FIG. 2 is for use in such installations.

Referring again to FIG. 1, a cover 29 is arranged on the oven chamber side of the door post 56, and has an angled flange 30 engaging with the projecting section 28, a flange 31, connected to the flange 30, which overlies the surface 26 of the door post, and also a front flange 32, parallel to the flange 30, which is in alignment with the outer surface of the side 22. The free edge 33 of the flange 32 has projections 61–63 (FIG. 4) each in the shape of a cone or truncated cone, which engage the front of the surface 26 of the door post, thereby minimising the conduction of heat between the door frame and the cover 29. Several distance pieces 34, 35, which are attached on the one side to the flange 31 and on the other side to the flange 30, keep the sections of the cover 29 spaced from the corresponding sections of the door frame. By this means there is provided a space 36 which is filled with heat insulating material. According to the embodiment shown in FIG. 1 the gap 7 runs around the outer side 37 of the flange 30 and is also filled with insulating material which is held in a groove 38 in the wall of the oven.

It can be seen from FIG. 3 of the drawings that the cover 29 is composed of individual sections which overlap each other in the manner of scales. Thus, not only are the vertical surfaces 26 of the posts 56, 57 of the door frame, on the oven chamber side, provided with sections 50, 51 and 52, 53 but also the upper transverse surface of the cross-piece 59 on the oven chamber side is provided with angle sections 54 and straight sections 55 of the cover 29. The lower cross-piece 58 of the door frame has only the usual wear plate 60. With the exception of the lower cross-piece, a circumferential space 39 is thereby obtained, which is filled with heat insulating material.

According to the embodiment illustrated, the distance pieces 34, 35 which support corresponding flanges 31, 30 of the sections of the cover 29, and one door frame itself, are provided with bores 64, 65, 66. These bores are in alignment with each other. Usually the bottom of the bore 64 is provided with a recess. The head of a bolt is located in this recess, the shank of the bolt passing through the registering bores 64, 65, 66. A nut is provided on the free threaded end of the bolt with which the part concerned is secured. Generally at least three bolts are used along the length of a section. They enable the components to be easily replaced if necessary, by loosening the nut or bolt.

Adjacent the distance piece 35 there is a blind hole 67 in the door post which can be aligned with corresponding bores 68, 69 in the distance piece 35 and in the flange 30 of the cover 29. As can be seen from FIG. 4, all together three bores 68 and 70 and 71 are provided. Together with the above-mentioned bores 64 they lie in common transverse planes, whereby the middle projection 62 of the top of each section is arranged in a common transverse plane with the bore 70. The purpose of the bores 68, 70, 71 is to receive tightening bolts which are not shown, which fix the sections at these points. The tightening bolts enable the sections to be easily replaced if they become worn.

The sections of the cover are mounted in such a way that they overlap in the manner of scales, as can be seen in FIGS. 3 and 5 where sections 52, 53 are shown by way of example. Cooperating tongues 76, 77 are defined by rebates in the adjacent edges 74, 75 of consecutive sections 52, 53. These tongues run along the whole length of the actual edge and are so dimensioned that together they form the thickness of the sections. On the other hand their length is adjusted so that the thermal variations in length of the sections can be taken into account.

According to the embodiment shown in FIG. 2, the profile of the door frame differs from the profile of the embodiment in FIG. 1 insofar as the longer side 24 of the rectangle is not continuously straight. On the contrary it ends in a projection 40 which is square in cross-section and which projects from the surface 26. It is therefore not possible to use the outer surface 41 of this projection 40 for bordering the space 36. According to this embodiment, therefore, the space 36 ends at the inner shoulder 42 of the projection 40. Moreover, the flange 31 of the cover 29 has a rebate 44 at its free end, that is, an undercut, whereby the end portion 45 of the flange 31 is in the form of a tongue, that is, the strength of its wall is reduced in comparison with the other areas of the flange 31. There is thereby produced an angular extension 46 of the space 36, which is filled with insulating material.

The cover 29 and door post are thus formed in such a way that they can be used in already existing coke ovens.

The cover 29 consists of heat-resistant material, whilst the filling of the space 36 can be effected with mineral wool as the insulating material.

We claim:

1. A self-sealing door assembly for a coke oven comprising a door frame and a door having a body, said door frame being affixed around the oven opening, the surfaces of the frame facing the oven defining a gap that is filled with heat insulating material and the outer front surfaces of the frame cooperating with sealing strips on the body of the door, said gap being defined between the vertical and transverse surfaces on the door frame facing the oven and an internal cover divided around the periphery of the door frame into a plurality of overlapping sections, said cover being angle-sectioned and having a first flange engaging the rear of the door frame, a second flange overlapping the surface of the door frame facing the opening, and having connected thereto a further flange that is in alignment with the front surface of the door frame, said first flange being provided with bores for receiving clamping bolts, and said second flange being provided with bores for receiving clamping bolts and with projections, each in the shape of a cone, for engagement with the door frame.

2. A self-sealing door assembly according to claim 1, wherein the sections are supported on distance pieces which are attached to the surfaces of the door frame.

3. A self-sealing door assembly according to claim 1 wherein the first and further flanges are substantially parallel.

4. A self-sealing door assembly according to claim 1, wherein the flanges of the cover are integrally formed as a unit.

5. A self-sealing door assembly according to claim 1, wherein the second flange is reduced in thickness at its free end.

6. A self-sealing door assembly according to claim 5, wherein the flanges of the cover are integrally formed as a unit.

* * * * *